US005640817A

United States Patent [19]

Bos

[11] Patent Number: 5,640,817

[45] Date of Patent: Jun. 24, 1997

[54] MODULAR SYSTEM FOR STUCCO FENCES/ WALLS

[76] Inventor: Pieter R. Bos, 814 Nevada Ave., San Jose, Calif. 95125

[21] Appl. No.: 443,347

[22] Filed: May 17, 1995

[51] Int. Cl.[6] ..... E04B 1/04

[52] U.S. Cl. ..... 52/270; 52/481.1; 52/421; 52/299; 405/287; 256/24

[58] Field of Search ..... 52/270, 479, 481.1, 52/421, 439, 437, 299; 256/19, 24; 405/287

[56] References Cited

U.S. PATENT DOCUMENTS

| | | | |
|---|---|---|---|
| 1,547,224 | 7/1925 | McLean | 52/481.1 |
| 2,523,920 | 9/1950 | Piatt | 52/421 X |
| 4,924,641 | 5/1990 | Gibbar, Jr. . | |
| 5,129,628 | 7/1992 | Vesper | 256/73 X |
| 5,184,808 | 2/1993 | Vesper . | |
| 5,353,562 | 10/1994 | Decker . | |
| 5,400,563 | 3/1995 | House et al. | 256/19 X |
| 5,404,685 | 4/1995 | Collins | 256/19 X |
| 5,421,558 | 6/1995 | Vesper | 256/24 X |

FOREIGN PATENT DOCUMENTS

| | | | |
|---|---|---|---|
| 2507222 | 12/1982 | France | 256/19 |
| 334725 | 3/1921 | Germany | 256/19 |
| 2411092 | 9/1975 | Germany | 52/481.1 |
| 1617113 | 12/1990 | U.S.S.R. | 52/479 |

*Primary Examiner*—Carl D. Friedman
*Assistant Examiner*—Aimee E. McTigue
*Attorney, Agent, or Firm*—Michael J. Hughes; Mark E. Baze

[57] ABSTRACT

A modular wall system (8) is provided for constructing ornamental, privacy and acoustical type walls having exterior surfaces of stucco and other decorative material. The system (8) features polymer spacers (14) and vertical metal sleeves (16) onto which are glued opposing pairs of substantially rectangular polymer panels (12). Spacers (14) and/or sleeves (16) that are present at the ends of some modules (10) extend out from between the pairs of panels (12) to allow adjacent modules (10) to be interlocked. A wall may be rapidly constructed since fabrication of the wall is almost entirely complete prior to transportation to the intended site, the only on-site construction being to dig footing holes (40) and pour concrete into the sleeves (16) to simultaneously form concrete footings (42) and concrete support columns (44). The slidably interlocking nature of the individual modules (10) makes the system (8) especially resistant to damage from earth movement.

20 Claims, 4 Drawing Sheets

MODULAR SYSTEM FOR STUCCO FENCES/ WALLS

TECHNICAL FIELD

The present invention relates generally to fences and non-load bearing walls, and more particularly to an easily fabricated, highly durable and low cost, composite modular wall form suitable for constructing ornamental, privacy and acoustical type walls having exterior surfaces of stucco and other decorative material.

BACKGROUND ART

A large number of wall structures and forms have been devised to reduce the time and cost of fabricating walls and foundation systems. These structures are typically comprised of opposing pairs of polymer panels which are held apart with an imaginative and often complex variety of ties and spacers. The panels incorporate a number of designs that permit adjoining panels to be interlocked in both horizontal and vertical directions to allow wall forms of varying lengths and heights to be assembled. Such polymer panels may be used to construct both structural and non-load beating walls. The panels may serve as forms for pouring concrete walls, after which the panels may either be left in place or removed, or they may simply be used in conjunction with upright supporting members and thereby be employed in a fence-like capacity. Furthermore, the polymer panel surface provides a suitable substrate for the attachment of wall board or gypsum for the interior wall of a building, and for the attachment of stucco or plaster for the exterior wall of a building or for a fence-type wall.

An example of a building wall form is disclosed in U.S. Pat. No. 4,924,641 issued on Nov. 15, 1990 to Gibbar. Gibbar's invention provides for pairs of polystyrene panels in which polystyrene blocks are used as spacers between the panels. The polystyrene blocks are integrally formed onto one of the panels, the other panel being glued onto the blocks to form a complete wall unit. The blocks set the thickness for the concrete that is poured between the panels. Blocks present at the ends of some pairs of panels extend beyond the edges of the panels in order to extend into, and thereby interconnect with, other laterally adjacent wall units. The wall units may be stacked vertically to give a desired wall height by means of T-shaped ties and straps. After insertion of reinforcement rods and appropriate bracing of the interconnected wall forms, concrete is poured into the interior spaces defined by the panels and blocks to give a monolithic wall structure.

Another application of polymer panels for use in building construction is revealed in U.S. Pat. No. 5,353,562 issued on Oct. 11, 1994 to Decker. Rather than using two panels to comprise a wall unit, Decker's invention employs individual polystyrene foam panels eight inches in thickness in which "troughs" have been routed or cut into both the top and side ends of the panels. The troughs are centered and are approximately six inches wide and six inches deep. Thus, the panels, when the top and side edges are viewed upon, have the appearance of being two, one inch panels spaced six inches apart. The panels may also be equipped with tongue and groove arrangements to permit the panels to interlock. When the panels are connected end to end, the vertical end troughs of adjacent panels create columnar spaces into which concrete is poured, after placement of reinforcing rods, to form concrete columns. The horizontal top troughs are similarly reinforced with rebar, filled with concrete, and troweled smooth. A second row of panels may be placed on top of the first and secured with spikes, which are placed in, and extend from, the wet cement in the top troughs. Thus, a structural skeleton comprised of concrete columns and beams is formed.

U.S. Pat. No. 5,184,808 issued on Feb. 9, 1993 to Vesper (U.S. Pat. No. 5,129,628 issued 14 Jul. 1992 to Vesper is substantially identical) shows polymer panels employed in a non-load bearing capacity for fence wall construction. Vesper's invention provides for expanded polystyrene or polyurethane panels that are formed with two vertical slots present at each panel end, the slots running substantially the height of a panel. The slotted panels fit onto steel I-beam posts having two pairs of opposing side flanges. The I-beam flanges fit into the vertical panel slots, thereby supporting the panels. The base of each post is embedded in a concrete footing, and a decorative aspect is provided to the panels by coating them with stucco.

While each of the foregoing inventions, and others of their genre, employ certain techniques that impart different advantages to wall form construction, all are more complex than is desirable to allow for the rapid and inexpensive construction of decorative, privacy type walls. In addition, such walls as presently made are very susceptible to damage from earth movement. Thus, the very substantial need still exists for a durable, modular type wall structure to which stucco and other decorative material may be applied, that can be constructed quickly and at a reduced cost, and that is resistant to earthquakes and other forms of earth movement.

DISCLOSURE OF THE INVENTION

Accordingly, it is an object of the present invention to provide an improved system for constructing ornamental, privacy and acoustical type walls having exterior surfaces of cementitious and other decorative material.

It is another object of the invention to provide a wall construction system that is easily manufactured and inexpensive.

It is a further object to provide a wall structure that is more durable than is conventionally available.

It is yet another object to provide a wall structure that is resistant to damage from earth movement and earthquakes, and to damage from high winds and strong sun exposure.

It is a still further object to provide a wall structure that can be built quickly without sacrificing quality of construction.

It is a still another object to provide a wall structure that can be easily repaired when damaged.

It is yet a further object of the invention to provide a wall construction system that is light in weight and easily transportable.

Briefly, a preferred embodiment of the present invention is a composite modular wall form for constructing ornamental, privacy and acoustical type walls having stuccoed exterior surfaces. The modular system is in the form of pairs of polystyrene panels that are glued onto polystyrene spacers and vertical metal sleeves. Spacers and/or sleeves that are present at the ends of some modules extend out from between the panels to allow adjacent modules to be interlocked. Walls embodying the invention as presently set forth may be put up quite rapidly because fabrication of the wall is almost entirely complete prior to delivery from the manufacturer, the only on-site construction being to dig footing holes, align the sleeves over the holes, position reinforcement rods within the sleeves (if needed),and then pour concrete into the sleeves to simultaneously form both concrete support columns and footings. Caps made of polystyrene or other materials may be used to cover the open tops of the modules, or a concrete cord may be poured into defined spaces along the tops of the modules. The wall is then stuccoed. The stucco may also be applied prior to delivery if a transport resistant grade/thickness of stucco is used.

An advantage of the present invention is that the wall system allows for rapid construction of fence walls with little on-site construction being necessary, thus providing for substantially reduced labor costs and minimal disruption to the property owner and his or her neighbors.

Another advantage of the invention is that the individual wall system modules are able to shift during earth movement relatively independent of one another and thus the wall system is resistant to damage from earthquakes and landslides.

Yet another advantage is that local damage to the wall system does not domino to adjacent sections; each is independent.

A further advantage is that if damage does occurs to an individual wall module, replacement of the damaged section is simple.

Still another advantage is that less maintenance of the wall structure is required than that of conventional type walls since the wall structure does not crack in the manner of concrete walls or concrete blocks when the supporting ground underneath shifts.

Yet a further advantage is that by minimizing the amount of concrete used to construct a wall, the potential for injury to occupants of a vehicle involved in an accident with the wall is reduced.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
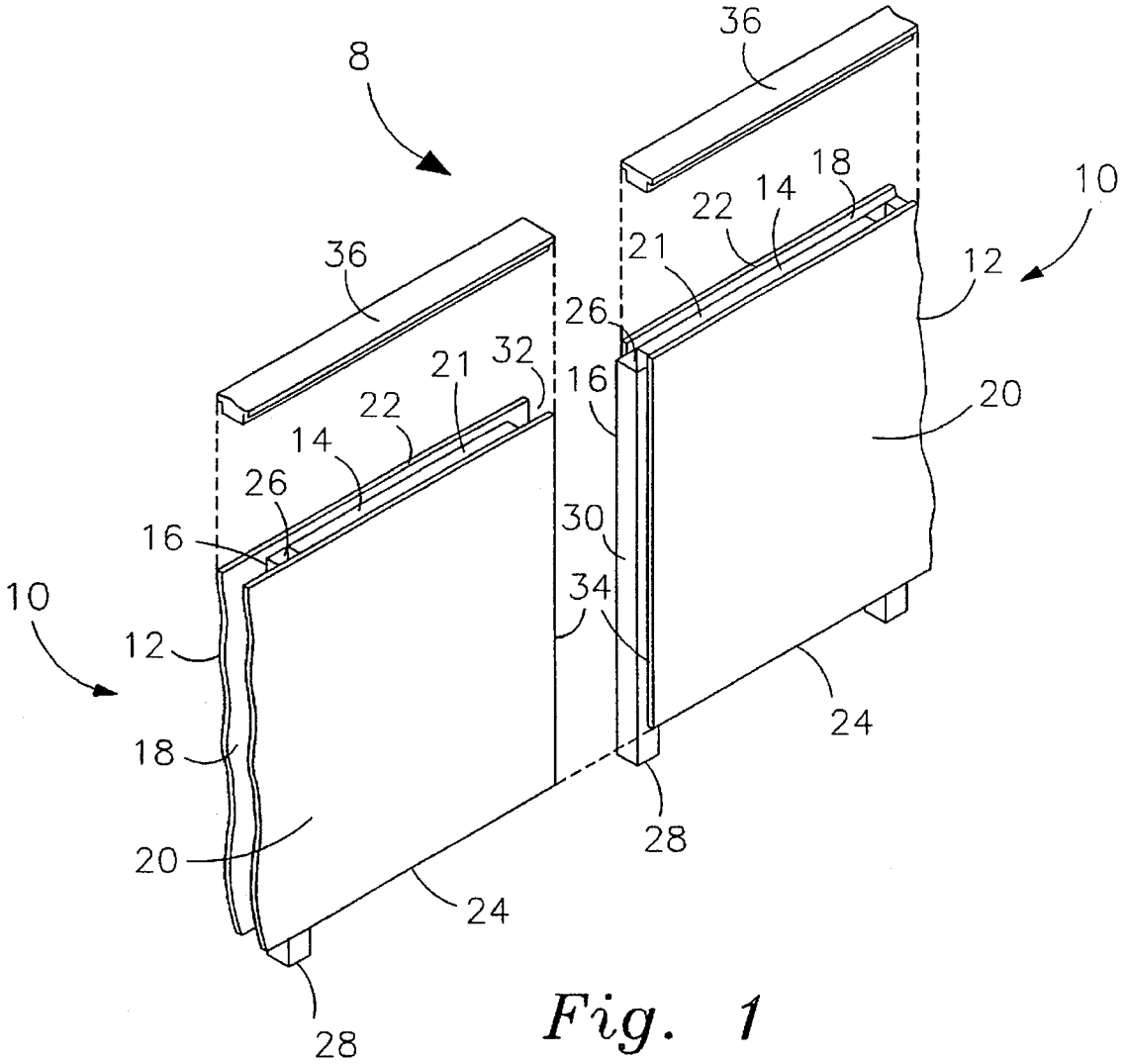
FIG. 1 is a perspective view of the wall system according to a preferred embodiment of the present invention, showing fragmentary sections of two wall modules, with the interconnection between the two, and between optional polystyrene caps, being indicated by dashed lines.

The preferred embodiments of the present invention are modular wall systems for ornamental barrier type walls. The wall system of one preferred embodiment is illustrated in a perspective view in FIG. 1 and is designated therein by the general reference character 8.

Referring to FIG. 1 of the drawings, sections of two wall modules 10 are shown prior to their being positioned at a use site. The wall modules 10 feature pairs of opposing panels 12 positioned apart by horizontal spacers 14 and sleeves 16. The preferred panels 12 are substantially rectangular in shape, with inner surfaces 18 and outer surfaces 20, and are made of a suitable foamed polymeric material. Polystyrene is the economically preferred material, although those with ordinary skill in the art will readily recognize that other polymeric materials, such as polyurethane, may also be used. The preferred panels 12 are approximately 3.6 cm (1.4 in) in thickness and are formed of one-pound density polystyrene, which has been found to be structurally adequate for most applications. The spacers 14 and sleeves 16 are attached to the inner surfaces 18 of opposing panels 12 by gluing with a suitable non-solvent based adhesive. Adhesives such as those sold under the trade names of LIQUID NAILS™ and BETTER THAN NAILS™ have been found to work well and are typically employed.

Figure 2:
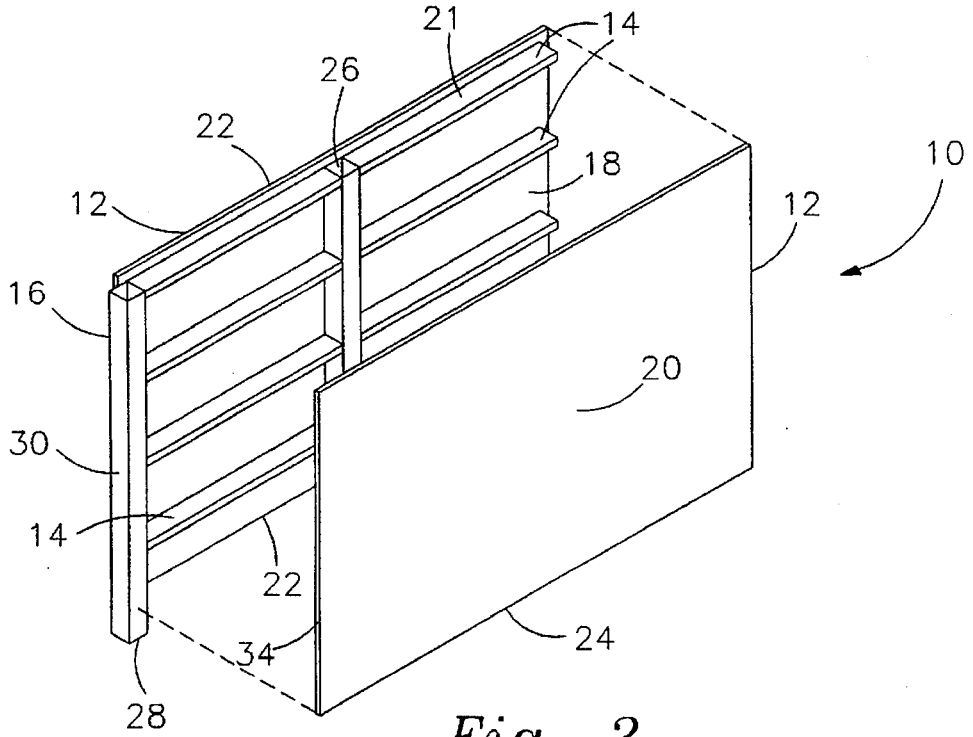
FIG. 2 is an exploded perspective view of a wall module, showing one panel as separated from the studs and sleeves.

FIG. 2 most clearly shows the arrangement of the spacers 14 and sleeves 16 relative to the panels 12. The preferred spacers 14 have a thickness of approximately 3.6 cm (1.4 in) and a width of approximately 10 cm (4.0 in) and, like the panels 12, are made of one-pound density expanded polystyrene. The spacers 14 are oriented horizontally with their length cut to fit between the sleeves 16. The uppermost spacers 21 are glued approximately 5.1–7.6 cm (2.0–3.0 in) below the upper edges 22 of the panels 12, for reasons as will be described below. The vertical distance between any two horizontal spacers 14 is such that the panels 12 are held apart in sturdy fashion to resist forces (such as wind, or a person leaning against the wall system 10) that would otherwise cause the panels 12 to sag inwardly towards one another. A center to center distance between the spacers 14 of approximately 30.5 cm (1.0 ft) has been found to be satisfactory and is typically employed.

Continuing to refer to FIG. 2, the preferred sleeves 16 are in the form of substantially square tubular columns measuring approximately 10 cm (4.0 in) on a side. The preferred material for the sleeves 16 is 16 gauge galvanized sheet steel, although sleeves 16 made of other materials, such as metals and plastics, and even moisture-proofed paperboards, may be successfully employed as the forms for receiving concrete poured therein. The sleeves 16 as shown in the figures are spaced at approximately 1.2 m (4.0 ft) intervals along the lengths of the panels 12. Placement of the sleeves 16 in actual practice is based upon structural engineering calculations considering soil and local wind conditions at the use site. The sleeves 16 are cut to extend approximately 5.1 cm (2.0 in) below the lower edges 24 of the panels 12. This additional lower length encourages concrete, when poured within the interiors 26 of the sleeves 16, to be forced up into the sleeves 16 rather than flowing out the bottoms 28 of the sleeves 16 to the side and onto the ground. As is perhaps most clearly seen in FIG. 1, sleeves 16 present at the ends of certain of the wall modules 10 are affixed to the inner surfaces 18 of the panels 12 such that approximately half of the widths of the sleeves 16 remain exposed. These exposed sleeve widths 30 effectively act as tenons to fit within corresponding mortise-like spaces 32 formed between pairs of opposing panels 12 of other adjacent wall modules 10 when the side edges 34 of panels 12 of adjacent wall modules 10 are abutted against one another. The sleeves 16 are cut shorter than the panels 12 in overall height by a distance equal to the distance having been previously described as allowed between the uppermost spacers 21 and the upper edges 22 of the panels 12, i.e., approximately 5.1–7.6 cm (2.0–3.0 in).

Again referring to FIG. 1, the reduced height for the sleeves 16, and the lowered placement of the uppermost horizontal spacers 21, permits caps 36 to be inserted onto the tops of the wall modules 10. The caps 36, like the panels 12 and spacers 14, may be made of a polymeric material, or they may be made of stone, brick, wood, marble or other appropriate materials. The caps 36 are secured by gluing, mortar, etc., and may provide a cornice or other decorative feature to the wall being constructed. Alternatively, and in place of the caps 36, the reduced height allows for concrete to be poured along the tops of the uppermost spacers 21 and the sleeves 16 (filled with concrete) to give a concrete cap or cord 38 (see FIG. 4). Such a concrete cord 38 may be sculptured or otherwise ornamentally shaped (in FIG. 4, the cord 38 has simply been rounded over). At the juncture between individual wall modules 10, such a concrete cord 38 is preferably "cut," that is, a knife is passed through the freshly poured concrete cord 38, and the rocks and pebbles found within the concrete are pushed to either side of the cut, at a point approximately where the side edges 34 of panels 12 of adjacent wall units 10 meet. This is done in order to weaken the cord 38 at that point and thereby promote a strategic breakage of the cord 218 in the event that earth movement should occur, such breakage allowing the modules 10 of the wall system 8 to move freely in relation to one another thereby preventing significant damage to the wall structure.

Figure 3:
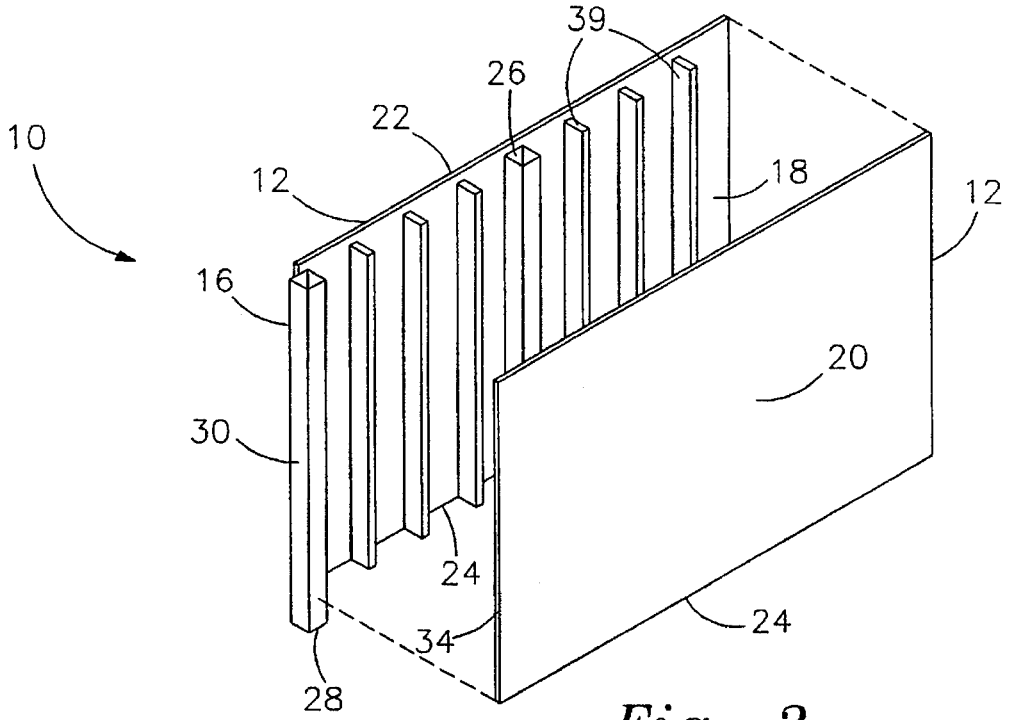
FIG. 3 shows an alternative preferred embodiment.

While in FIGS. 1 and 2, the spacer members are shown as being horizontally positioned, it will be clear to those of ordinary skill in the art that the positioning of such spacers may be other than horizontal. Vertical, diagonal, and cross-diagonal orientations, or any similar arrangement or combination of orientations may also be employed to hold the panels 12 apart. Shown in FIG. 3 is an alternative preferred embodiment employing vertical spacers 39. These vertical spacers 39 have the orientation and appearance of typical construction-type wooden "studs." As with the sleeves 16, the vertical spacers 39 are not cut to be flush with the upper edges 22 of the panels 12, but rather are cut to be lower in height by approximately 5.1–7.6 cm (2.0–3.0 in). As with the horizontal spacers 14, a distance between vertical spacers 39 (and between spacers 39 and sleeves 16) of approximately 30.5 cm (1.0 ft) has been found to give adequate support to the panels 12. As compared to the vertical spacers 39, the use of horizontal spacers 14 gives the desirable advantage of providing a built-in surface of appropriate height for the pouring of the aforementioned concrete cord 38. The horizontal spacers 14 also have the advantage of not having to be re-sized for different wall heights. Vertical spacers 39, on the other hand, do not have to be re-cut for different wall length applications, and where it is desirable to pour a concrete cord 39, it is a simple matter to lay a wooden "two-by-four" (or other rigid flat-surface material) over the tops of the sleeves 16 (already filled with concrete) and vertical spacers 39, and thereby provide a surface for the pouring of a concrete cord 38. In terms of the structural integrity of the resulting wall, there is little or no advantage to either configuration.

It should also be noted that, while in the particular illustration of FIG. 2 (and FIG. 3), a substantially rectangular wall module 10 of approximately 1.5 m (5.0 ft) in height by 2.4 m (8.0 ft) in length by 17 cm (6.8 in) in overall thickness is depicted, it would be obvious to one of ordinary skill in the art that the panels 12, spacers 14 (and 39) and sleeves 16 may be cut to such dimensions as to give wall modules 10 of essentially any geometry for a virtually unlimited number of applications, desired effects, and to allow varying conformations of the wall system 8 for application to any particular terrain that might be encountered.

Figure 4:
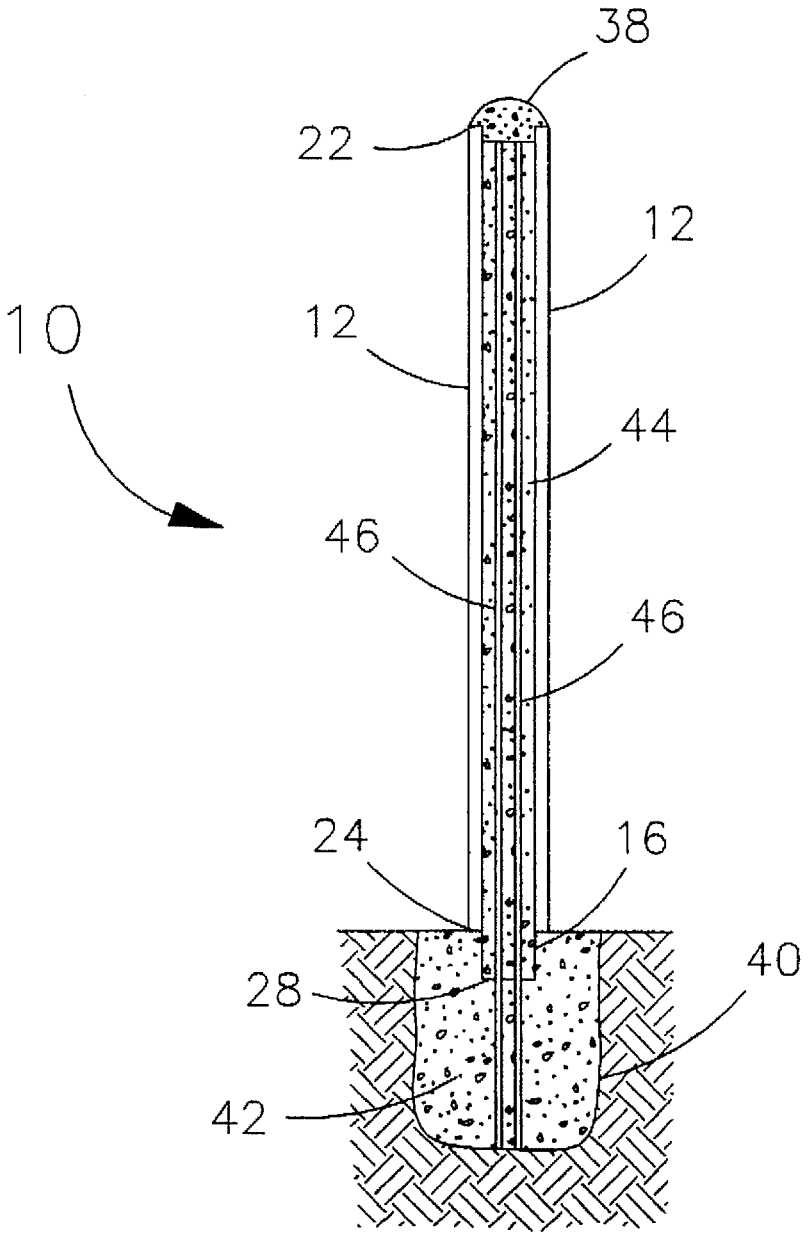
FIG. 4 is a cross-sectional side view of a module, taken through a sleeve containing concrete and reinforcing bars, with a concrete cord atop the module.

Referring now to FIG. 4, the modular wall units 10 are positioned over footing holes 40 dug at appropriate intervals at the use site to line up with the sleeves 16 present in any number of interconnected wall modules 10. The dimensions for the footing holes 40 will depend on soil and weather conditions at the site, but footing holes 40 of approximately 30.5 cm (1.0 ft) foot in diameter and 70 cm (2.0 ft) in depth are generally found to suffice. Concrete poured within a sleeve 16 simultaneously forms both a concrete footing 42 and a concrete column 44. Prior to pouring the concrete, two 1.27 cm (0.5 in) steel reinforcing rods or rebars 46 may be positioned vertically within the sleeves 16 for additional support. In practice, the size of the rebars 46 employed will be determined by structural engineering calculations appropriate for the particular site as dependent on weather and other conditions. The rebars 46 are typically positioned in alignment with each other on a line perpendicular to the panel surfaces (18 and 20) in order to give the greatest support. Engineering calculations indicate that such reinforced concrete columns, placed on 1.2 m (4.0 ft) centers as described, will provide a 1.8 m (6.0 ft) high wall as embodied in the present invention the capability to withstand winds of up to 113 km/h (70 mph). It will be obvious to those of ordinary skill in the art that a similar wind resistance may be obtained by increasing the size of the sleeves 16 and thus the size of the concrete column 44, rather than by adding rebar 46 reinforcement. A wall of greater overall thickness than approximately six inches, as described herein, may be desired for certain applications and effects in any event.

Figure 5:
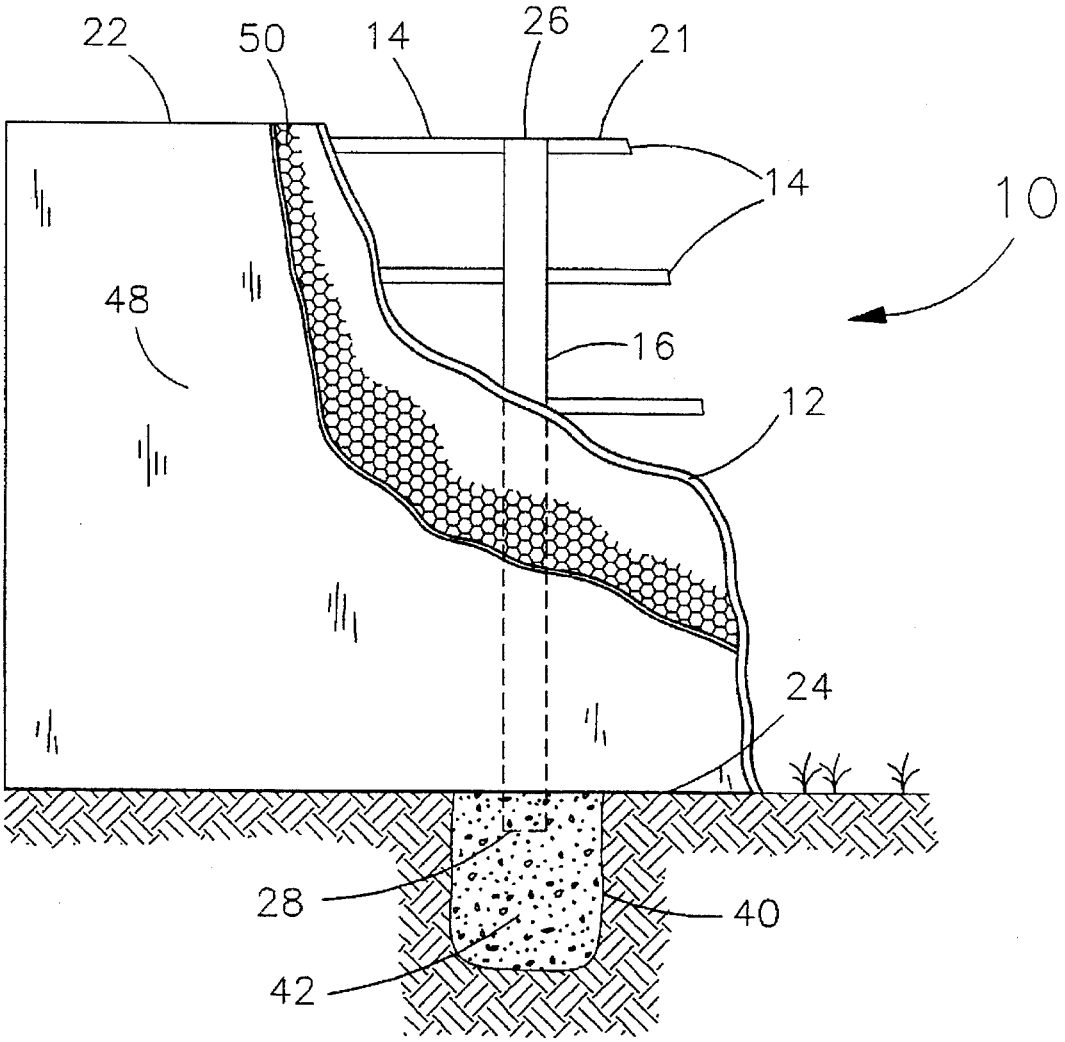
FIG. 5 is a fragmentary front elevational view of the modular wall system successively cut away intermediately to reveal the layered components therein.

In FIG. 5, the panels 12 are shown covered with cementitious material or stucco layer 48. Open-mesh reinforcing fabric or screen 50 may be used to cover the panels 12 prior to application of the stucco layer 48. The screen 50 is anchored to the panels 12 with a suitable means such as tape, staples, or gluing, and helps provide additional support to increase adhesion and minimize cracking and crumbling of the stucco layer 48. The screen 50 may be made of wire or mesh formed from metal, glass, or polymer, in any suitably open-mesh form. Stucco layer 48 may also be applied directly to the panels 12 using a spray adhesive/bonder that increases the adherence of the stucco material. Pre-made stucco mixes that are commercially available and typically employed are sold under the tradenames XL COAT™ and SUPERIOR COAT™. Decorative horizontal or vertical extensions (strips or pilasters) made of materials similar to that used for the caps 36 may also be added to the outer surfaces 20 of the panels 12 as well.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to be interpreted as encompassing the entire spirit and scope of the invention.

INDUSTRIAL APPLICABILITY

The modular wall system 8 is intended to be used in virtually any situation calling for a decorative privacy or acoustical type of wall. The manner of use of the system 8 is quite simple. An assembly of many wall units 10 is preferably manufactured prior to transportation to the use site, the composition of the wall units 10 making them extremely light and easily transportable. Once at the use site, fence lines are marked off and footing holes 40 are dug to be in line with the bottoms 28 of the sleeves 16 present within the wall units 10. The wall system 8 may be made to follow the grade of the land, the units 10 being cut at the site using hand or power saws or "hot-wire" polystyrene cutters to conform to complex terrain and obstacles. The units 10, of course, may also be cut into predetermined shapes prior to delivery to the use site. The wall system 8 may bridge swales, culverts, or like gaps by increasing the lengths of the sleeves 16, if necessary, to give concrete columns 44 of greater height.

Standard construction bracing techniques using wood two-by-fours, or wood or metal bracing of other dimensions, are used to position and hold the wall units 10 upright during the process of pouring the concrete. Wood "saddles," commonly used in the pouring of concrete walls generally, and which go over the tops of the wall modules 10, are typically employed as part of the bracing. After the wall units 10 are appropriately braced, reinforcing rods 46 are inserted inside the sleeves 16 and either driven vertically into the bottom of the footing holes 40, or hung by wires from the tops of the sleeves 16. Concrete is then pumped into the sleeves 16 using standard methods. The concrete fills the footing holes 40, and aided by the fact that the bottoms 28 of the sleeves 16 extend into the footing holes 40 by several centimeters (inches), the concrete backs up into the sleeves 16 to form the concrete columns 44. The application of the concrete does not require any great skill or training. The sleeves 16 are merely filled and troweled level. No leveling or complex setting is required.

Once the concrete is poured, caps 36 are glued or mortared onto the tops of the wall units 10. As indicated previously, instead of using caps 36, immediately after the concrete columns and footings (44 and 42) are poured, a concrete cord 38 may also be conveniently poured along the tops of the spacers 21 and sleeves 16. Once the concrete columns and footings (44 and 42) have cured, the bracings are removed, wire screen 50 is attached onto the outer surfaces 20 of the panels 12, and a coating of stucco material 48 is applied.

Most importantly for earthquake prone regions of the world, such as California, is the fact that because the wall system 8 is comprised of modular units 10 that interlock in a slidable manner, in the event of an earthquake or earth movement of any type, walls constructed according to the present invention are much less susceptible to damage, since the individual sections 10 of the system 8 can move relatively independently of one another. For the preceding, and other above reasons, it is expected that the modular wall system 8 of the present invention will have widespread industrial applicability. The system 8 provides substantial advantages in that it is inexpensive and makes wall construction highly convenient and simple. Therefore, it is expected that the industrial applicability and commercial utility of the present invention will be extensive and long lasting.

What is claimed is:

1. A modular wall construction system, comprising:

a plurality of panels formed of polymeric material, said panels being arranged in pairs that are substantially parallel, said panels further having ends, bottom and top edges, outer surfaces and opposing inner surfaces;

a plurality of spacer members formed of polymeric material, said spacer members having a width, a length, and a thickness, said spacer members further being attached by adhesive means onto the opposing inner surfaces of said panels such that said panels are supportably held apart a distance equal to the width of said spacer members;

a plurality of concrete-column forming sleeves, said sleeves being hollow and having a width, a length, and a thickness, the width being substantially identical to the width of said spacer members, said sleeves further being attached by adhesive means onto the opposing inner surfaces of said panels; and wherein a portion of a least one member of the group consisting of said spacer member and said sleeve extends beyond the ends of a pair of said panels to slidably interlock with an adjacent pair of said panels.

2. The wall system of claim 1 further including a cap, said spacer members and said sleeves being disposed a sufficient distance from the top edges of said panels to allow the cap to be inserted between the opposing inner surfaces of pairs of said panels.

3. The wall system of claim 1 wherein one or more of said spacer members are disposed in a horizontal orientation near the top edges of said pairs of panels, such orientation allowing a cord of concrete to be poured into the space defined by the horizontal spacer members and the opposing inner surfaces of pairs of said panels and thereby form a concrete cap.

4. The wall system of claim 1 further including the outer surfaces of said panels being covered with a cementitious material.

5. The wall system of claim 1 wherein said polymeric material is polystyrene.

6. The wall system of claim 1 wherein said sleeves are made of material selected from the group consisting of metals, plastics, polymers, and wood products.

7. The wall system of claim 1 wherein said adhesive means is a non-solvent based adhesive glue.

8. A method for constructing a wall, comprising:

providing a plurality of pairs of polymer panels arranged in substantially parallel fashion and held apart by, and adhesively attached to, polymer spacer members and upright sleeves, said panels having ends, top and bottom edges, and outer surfaces, the spacer members having lengths and thicknesses, the sleeves having bottoms;

digging footing holes in alignment with the bottoms of the sleeves; and pouring concrete into the sleeves to simultaneously form concrete footings and concrete support columns.

9. The method of claim 8 wherein the thickness of at least one sleeve extends beyond the ends of one or more of the pairs of panels to allow adjacent pairs of panels to slidably interlock.

10. The method of claim 8 wherein the length or thickness of at least one spacer member extends beyond the ends of one or more of the pairs of panels to allow adjacent pairs of panels to slidably interlock.

11. The method claim 8 wherein the sleeves extend beyond the bottom edges of the pairs of panels in order to assist the poured concrete in backing up into the sleeves.

12. The method of claim 8 further including the step of providing a cap, the spacer members and sleeves being disposed a sufficient distance from the top edges of the panels to allow the cap to be inserted between pairs of panels.

13. The method claim 8 wherein one or more of the spacer members are disposed in a horizontal orientation near the top edges of the pairs of panels, and further including the step of pouring concrete onto the horizontally disposed spacer members to form a concrete cap.

14. The method of claim 8 further including the step of covering the outer surfaces of the panels with a cementitious material.

15. The method of claim 8 wherein the polymer panels and polymer spacer members are made of polystyrene.

16. The method of claim 8 wherein the sleeves are made of material selected from the group consisting of metals, plastics, polymers, and wood products.

17. The method of claim 8 wherein the adhesive attachment is made using a non-solvent based adhesive glue.

18. A modular wall construction system, comprising:

a plurality of panels formed of polymeric material, said panels being arranged in pairs that are substantially parallel, said panels further having ends, bottom and top edges, outer surfaces and opposing inner surfaces;

a plurality of spacer members formed of polymeric material, said spacer members having a width, a length, and a thickness, said spacer members further being attached by adhesive means onto the opposing inner surfaces of said panels such that said panels are supportably held apart a distance equal to the width of said spacer members;

a plurality of concrete-column forming sleeves, said sleeves being hollow and having a width, a length, and a thickness, the width being substantially identical to the width of said spacer members, said sleeves further being attached by adhesive means onto the opposing inner surfaces of said panels; and wherein the lengths of said sleeves extend beyond the bottom edges of said panels, such extension encouraging concrete poured into said sleeves to be backed up into said sleeves when said sleeves are positioned over footing holes into which the concrete is simultaneously poured.

19. The wall system of claim 18 wherein one or more of said spacer members are disposed in a horizontal orientation near the top edges of said pairs of panels, such orientation allowing a cord of concrete to be poured into the space defined by the horizontal spacer members and the opposing inner surfaces of pairs of said panels and thereby form a concrete cap.

20. The wall system of claim 18 wherein said sleeves are made of material selected from the group consisting of metals, plastics, polymers, and wood products.

* * * * *